US008959692B2

(12) United States Patent
Mellier et al.

(10) Patent No.: US 8,959,692 B2
(45) Date of Patent: Feb. 24, 2015

(54) DEVICE FOR DIVERTING A STRUCTURAL CABLE SUCH AS A STAY AND A STRUCTURE SO EQUIPPED

(75) Inventors: Erik Mellier, Viroflay (FR); Stephane Joye, Boulogne-Billancourt (FR)

(73) Assignee: Soletanche Freyssinet, Rueil Malmaison (FR)

( * ) Notice: Subject to any disclaimer, the term of this patent is extended or adjusted under 35 U.S.C. 154(b) by 0 days.

(21) Appl. No.: 13/992,715

(22) PCT Filed: Dec. 7, 2011

(86) PCT No.: PCT/FR2011/052897

§ 371 (c)(1),
(2), (4) Date: Jun. 7, 2013

(87) PCT Pub. No.: WO2012/076815

PCT Pub. Date: Jun. 14, 2012

(65) Prior Publication Data

US 2013/0255170 A1 Oct. 3, 2013

(30) Foreign Application Priority Data

Dec. 8, 2010 (FR) ..... 10 60270

(51) Int. Cl.
*E01D 19/16* (2006.01)
*E04C 5/08* (2006.01)
*E01D 19/14* (2006.01)

(52) U.S. Cl.
CPC .. *E04C 5/08* (2013.01); *E01D 19/14* (2013.01)
USPC ..... 14/22; 14/18; 14/23; 14/21; 52/223.13

(58) Field of Classification Search
USPC ..... 52/223.13, 223.14, 223.1, 223.3; 14/18, 14/19, 20, 21, 22, 23, 24, 25, 26; 24/122.6, 122.3, 130; 405/224.4
See application file for complete search history.

(56) References Cited

U.S. PATENT DOCUMENTS

| | | | | |
|---|---|---|---|---|
| 3,152,668 | A * | 10/1964 | Smith | 52/148 |
| 4,505,081 | A * | 3/1985 | Dinis et al. | 52/223.14 |
| 4,574,545 | A * | 3/1986 | Reigstad et al. | 52/223.6 |
| 4,606,380 | A * | 8/1986 | Jartoux | 138/122 |
| 4,878,327 | A * | 11/1989 | Nutzel et al. | 52/223.13 |
| 4,977,715 | A * | 12/1990 | Krumbach | 52/223.14 |
| 5,197,157 | A * | 3/1993 | De La Fuente | 14/18 |
| 6,523,207 | B1 * | 2/2003 | Stubler et al. | 14/22 |
| 6,715,176 | B2 * | 4/2004 | Stubler et al. | 14/22 |

(Continued)

FOREIGN PATENT DOCUMENTS

| | | |
|---|---|---|
| DE | 88 10 423 U1 | 11/1998 |
| EP | 0 437 143 A1 | 7/1991 |

(Continued)

*Primary Examiner* — Chi Q Nguyen
(74) *Attorney, Agent, or Firm* — McKenna Long & Aldridge LLP

(57) ABSTRACT

The structural cable has several stretched tendons (4). It is diverted in a device comprising a body crossed by conduits (10). Each conduit has a wall to guide one of the tendons along a curved path. The wall of the conduit has a tendon support area (11) directed toward the interior of the curve of the path. This support area presents, in the center portion of the conduit and transverse to the curved path, a section in the shape of a circular arc whose radius is appreciably equal to half the external diameter of the tendon. The central portion of the conduit has a cross-section enlarged outside the support area.

18 Claims, 3 Drawing Sheets

(56) References Cited

U.S. PATENT DOCUMENTS

| | | | | |
|---|---|---|---|---|
| 6,748,708 | B1 | 6/2004 | Fuzier et al. | |
| 6,880,193 | B2 * | 4/2005 | Figg et al. | 14/21 |
| 7,003,835 | B2 * | 2/2006 | Figg et al. | 14/21 |
| 7,900,306 | B2 * | 3/2011 | Bournand et al. | 14/22 |
| 8,650,691 | B2 * | 2/2014 | Delavaud et al. | 14/22 |
| 2009/0158535 | A1 | 6/2009 | Adrian et al. | |

FOREIGN PATENT DOCUMENTS

| | | | |
|---|---|---|---|
| WO | WO 00/75453 | A1 | 12/2000 |
| WO | WO 2007/121782 | A1 | 11/2007 |

* cited by examiner

DEVICE FOR DIVERTING A STRUCTURAL CABLE SUCH AS A STAY AND A STRUCTURE SO EQUIPPED

This Application is a 35 U.S.C. §371 National Stage Entry of International Application No. PCT/FR2011/052897, filed Dec. 7, 2011 and claims the benefit of priority to French Application No. 10 60270, filed Dec. 8, 2010, each of which are incorporated by reference in their entirety herein.

BACKGROUND OF THE INVENTION

The present invention concerns devices for deviating structural cables, especially stays.

At present it is common to make structural cables as a bundle of individual stretched tendons anchored at their ends. The design of an construction work may involve diverting the cable in one or more areas of its path.

In stayed structures, the cables have an upper part situated near a tower and lower extremities anchored to the suspended structure, for example, the deck of a bridge. In a conventional design, the upper extremity of each cable is anchored to the tower. In other stayed structures, the cables follow paths whose general shape is that of an inverted V, and they are diverted to the tower by means of a device commonly referred to as a saddle.

At the saddle, the cable strands follow curved paths, typically with a substantially constant radius of curvature. Preferably, the tendons extend uninterruptedly along the saddle. Sufficient friction must be provided between the tendons and the saddle to avoid unwanted slippage.

WO 2007/121782 A1 discloses a saddle wherein each strand forming a tendon of the cable is received in an individual conduit whose wall presents, on either side of the plane containing the curved path of the strand, two inclined faces, giving the conduit a generally V-shaped cross-section. The V shape of the conduit's cross-section immobilizes the strand through a wedge effect whenever tension is applied to it by the load on the structure. This saddle design is not without its drawbacks. In particular, the contacts between the strand and the wall of its conduit are local, which is not favorable to good distribution of local stresses. Moreover, the saddle is not compatible with the use of individually sheathed strands because the individual sheath of a strand would be damaged by the pinching force brought about by the V shape of the conduit. Nonetheless, individually sheathed strands are frequently preferred for making structural cables because their corrosion resistance is enhanced by the insulation conferred by the sheath. If, however, use such strands with the saddle of WO 2007/121782 A1 is desired, the sheaths must be removed on the length of the strands placed inside the saddle, which requires the use of special measures to sufficiently insulate the metal of the strands. In spite of these measures, which can be complex and costly, stripping the tendons near the saddle risks introducing weakness into the anticorrosion protection of the stays.

An object of the present invention is to propose a different saddle design, which reduces the incidence of the aforementioned problems, in particular by ensuring adequate transmission of stresses within the curved path followed by the tendons.

SUMMARY OF THE INVENTION

The invention thus proposes a device for deviating a structural cable having a plurality of stretched tendons. The device comprises a body traversed by conduits. Each conduit has a wall to guide one of the tendons along a curved path. The conduit wall having a support area for supporting that tendon, located on an interior side of the curvature of the path, which support area presents, at least in a central portion of the conduit and transverse to the curved path, a cross-section in the shape of a circular arc having a radius substantially equal to half the external diameter of the tendon, the central portion of the conduit having a widened cross-section outside the support area The tendons are held in the conduit, preventing them from sliding along the curved path, by the friction on the tendon in the support area of the wall of the conduit, whose roughness may be more or less significant. The tendon is in contact with this support area over a surface having a certain extent, depending on the shape of the circular arc, whose radius is adapted to the tendon. It is pressed against this support area by the tension applied to the cable.

Because of the good distribution of stresses transmitted between the tendons and the wall of their conduits, the deviation device enables the use of tendons each of which has a metal strand and a plastic sheath surrounding the strand. The sheath can thus pass uninterrupted through the saddle and up to the cable anchors by being applied to the support area of the wall of the conduit.

It has been determined that an angular sector of at least 60° for the shape of the arc of circle of the section of the support area provides sufficient frictional blocking in a number of configurations. This angular sector may, in particular, be in a range between 90 and 120°.

It is generally appropriate for the conduits to present a cross-section that is sufficient to allow the tendons to be threaded without difficulty. This property can be obtained by providing a cross-section that is large enough to contain a circle whose diameter is at least 2 mm greater than the external diameter of the tendon.

The shape of the cross-section of the central portion of the conduit outside the support area may be that of an arch whose diameter is greater than the external diameter of the tendon. An arched shape, circular, for example, avoids undesirable concentrations of stresses in the material situated between the individual conduits of the device.

In order to accommodate a margin of angular variation of the cable on either of the sides of the device, the conduit can be shaped in such a way that its cross-section widens outwardly on at least one side of its central portion. The widening can in particular follow, on the interior side of the curvature of the path, a substantially circular generatrix whose radius is less than the radius of curvature of the path in the central portion of the conduit.

In an embodiment, the deviation device further comprises a curved tube to receive the structural cable, the body provided with conduits being housed inside the curved tube.

Another aspect of the invention relates to an construction work such as, for example, a cable-stayed bridge, comprising at least one structural cable having a plurality of stretched tendons, anchors for the tendons at the extremities of the cable, and at least one cable deviation device between the two anchors, this device being as defined above.

BRIEF DESCRIPTION OF THE DRAWINGS

Other features and benefits of the present invention shall appear from the following description of a non-limiting embodiment by referring to the attached drawings, in which.

DESCRIPTION OF EMBODIMENTS

Figure 1:
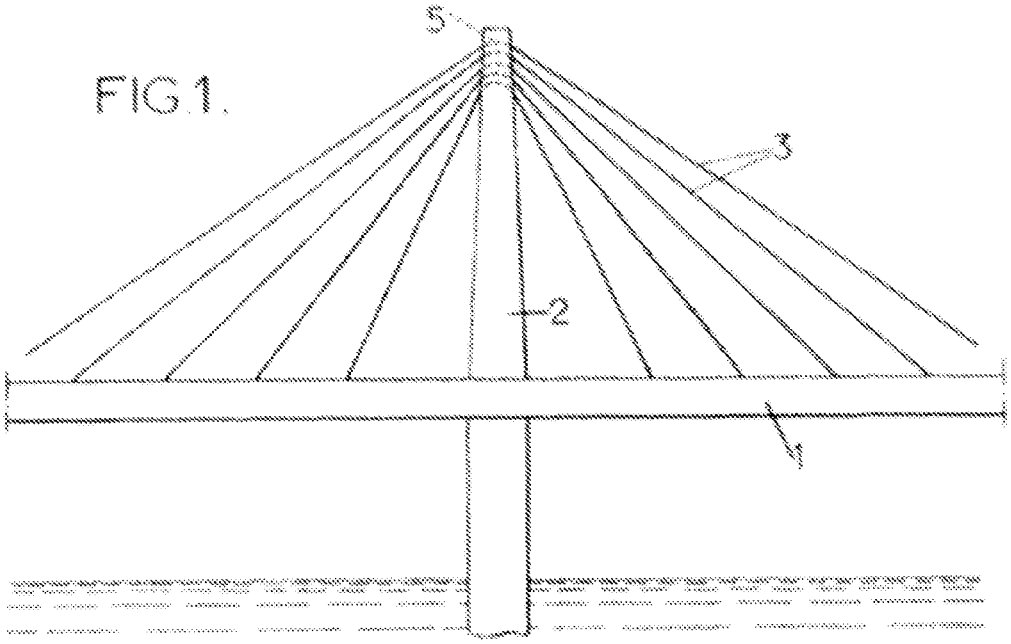
FIG. 1 is a diagram of a cable-stayed bridge to which the invention may apply.

The embodiment of the construction work shown in FIG. 1 consists of a cable-stayed bridge. The deck 1 of such a bridge is conventionally supported by one or more towers 2 by means of stays 3 that follow inclined paths between the tower and the deck. At tower 2, each stay 3 extends through a deviation device 5 realized in accordance with the invention, hereinafter referred to as a saddle.

Figure 2:
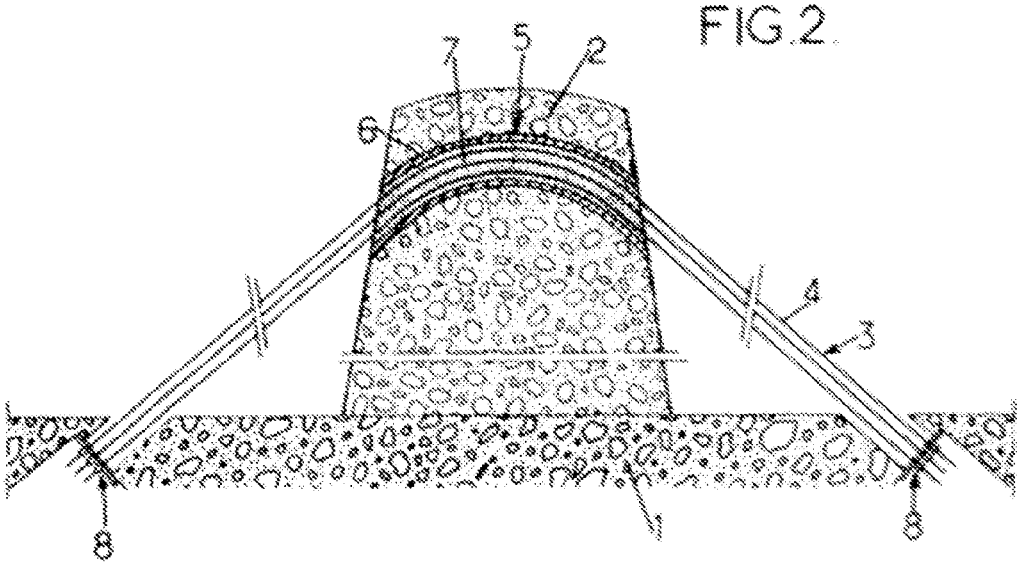
FIG. 2 is a very schematic view of a stay equipped with an embodiment of the diverting device.
Figure 3:
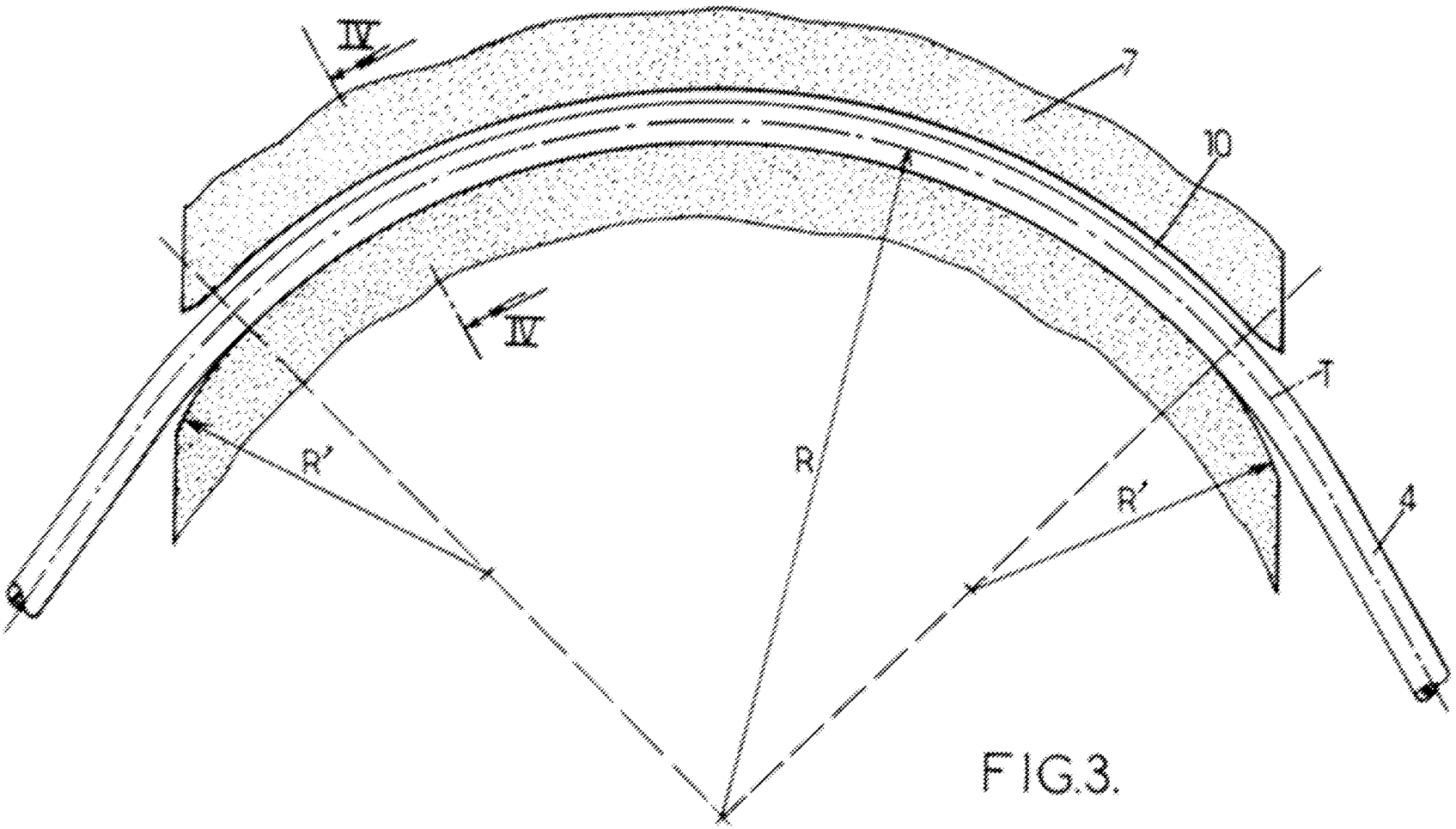
FIG. 3 is an axial cutaway of a conduit belonging to the diverting device.

In the embodiment shown in FIG. 2, the saddle 5 has a curved metal tube 6 buried in the concrete used to make the tower 2. The curved tube 6 has, for example, been shaped by bending a steel tube, then placed in the appropriate geometric configuration before the concrete of the tower 2 is poured. Here, the structural cable is formed by a stay 3, composed of a plurality of stretched tendons 4 which extend through saddle 5 without interruption. The tendons 4 preferably consist of individually sheathed strands, wherein the metal strand and its plastic sheath are both uninterrupted within the saddle 5. Through the saddle, each tendon 4 follows a curved path T (FIG. 3) defined by an individual conduit 10. The conduits 10 are formed in a body 7 made of molded material housed inside the curved tube 6.

On the exterior of saddle 5, the stay 3 freely extends to the two anchors 8 installed on deck 1. These anchors 8 can, for example, be in accordance with that described in WO 00/75453 A1.

Each of the conduits 10 arranged in the saddle 5 receives a respective sheathed strand 4. In their central portion, they preferably follow a curved path T of constant radius R. In this portion, the cross-section of the conduit 10 has, for example, the shape shown in FIG. 4, where the wall of the conduit has a support area 11 on the interior side of the curvature of the path T. The shape of the support area 11 is a circular arc of radius r.

Figure 4:
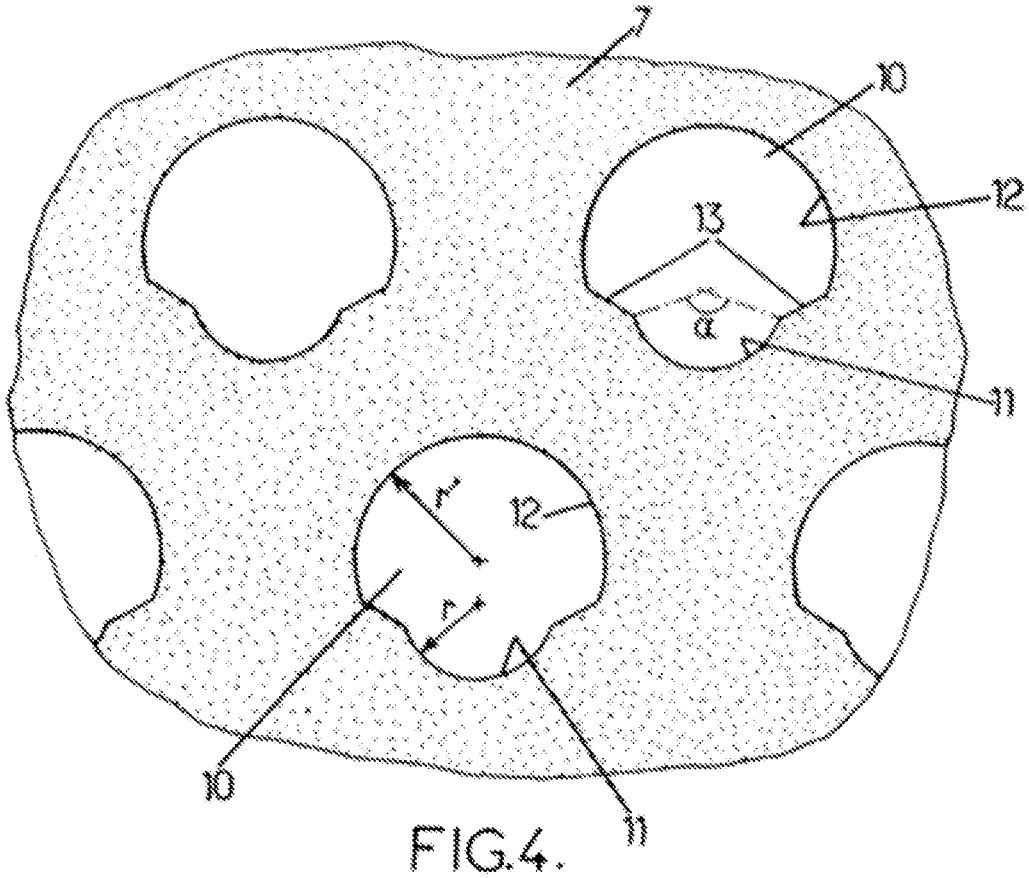
FIG. 4 is a cross-section of the diverting device, along plane IV-IV, as indicated in FIG. 3.
Figure 5:
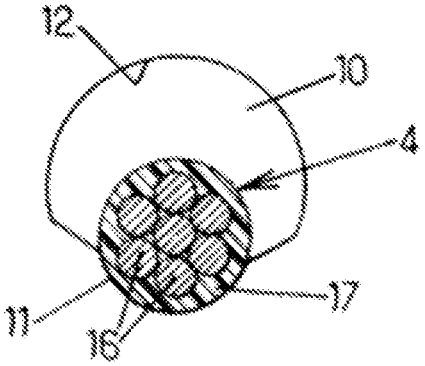
FIG. 5 is a cross-section of a conduit in which a cable tendon is housed.

As shown in FIGS. 4 and 5, the radius r of the circular arc shape of the support area 11 in the central portion of the conduit 10 corresponds to half the external diameter of the tendon 4. Thus, the support area 11 provides a relatively extensive contact area between the wall of the conduit 10 and the periphery of the tendon 4, which creates a frictional force suitable for holding the tendon in position whenever tension is applied by the load on the structure. The angular sector $\alpha$ over which the support area extends is preferably at least 60°. Optimally, this angular opening $\alpha$ is in the range of 90° to 120°.

Figure 6:
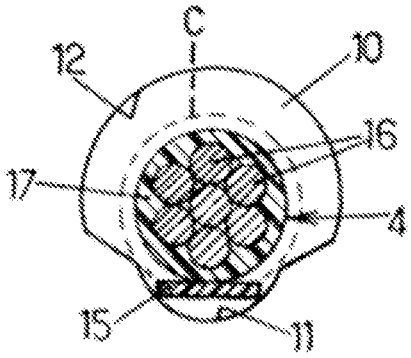
FIG. 6 is a view similar to that of FIG. 5, illustrating the conduit and the tendon during installation of the cable.

The upper portion 12 of the wall of the conduit 10, on the exterior side of its curvature, is wider than the support area to allow the unencumbered introduction of the tendon 4 when installing the stay. This widening of the central portion of the conduit outside the support area 11 can be realized by giving the upper portion 12 a cross-section in the shape of an arch whose diameter is greater than the exterior diameter of the tendon. It has been found that introduction of the tendon 4 in the conduit can be accomplished without difficulty when the cross-section of the conduit, in its central portion, is sufficient to contain a circle, C, whose diameter is at least 2 mm greater than the external diameter of the tendon 4, as shown in FIG. 6.

Thus, the tendon 4 can be threaded through its conduit without rubbing against saddle 5. To that end, a movable shim 15 can be used, for example, in the shape of a ribbon of plastic material, before threading. Once the tendon 4 has been installed, the shim 15 is removed, the tendon 4 then being laid in the support area 11.

The arched shape of the upper portion 12 of the wall of the conduit 10 can, in particular, have a circular profile of radius r'>r, with radial shoulders 13 connecting the support area 11 to the upper portion 12. The rounded shape of the arch is favorable to the vertical flow of the compressive stress occurring in the molded matrix 7 of the saddle 5.

In a preferred embodiment, the cross-section of the conduit 10 widens toward the exterior on either side of the central portion. This widening, visible in FIG. 3, can be used to guide the deflection of the tendons, which results from variations in the load on the cables.

On the interior side of the curvature of the path T, the widening of the cross-section of the conduit 10 can follow a generatrix whose shape is preferably circular, with a radius R' that is less than the radius of curvature R of the path T in the central portion of the conduit 10. The fact that the radius R' is constant enables the bending stresses to which the tendons 4 are subject to be limited.

The widening of the cross-section of the conduit 10 at both ends may result from a homothetic transformation of the shape shown in FIG. 4. A variant consists in gradually enlarging outwardly the interior portion of the section of the conduit so that it tends toward the circle of radius r' along the outer face of the saddle 5. Another variant consists in putting, on either side of the central portion of constant section of the conduit 10, a trumpet-shaped widening of circular cross-section whose smallest diameter is equal to r'. In this way, the widening can be simply realized with a machined guide piece placed in the opening of the conduit 10.

The central portion of the conduits 10 can be realized by being molded in the material 7, e.g. filler mortar, constituting the matrix of the saddle 5. In this way, negative molds having the shape of the conduits 10 are disposed in the curved tube 6. Their positions and transverse spacing are maintained by guides regularly spaced in the tube 6. The tube 6 is then filled with a hardenable material such as a high-resistance mortar. Unmolding can then take place either by mechanical destruction of the molds, or by dissolution, or by shrinkage. This realization of the saddle by molding can take place in a factory. At the worksite, the saddle thus realized is lifted to the tower and placed in the predetermined position. Once the tower is complete, the tendons 4 of the stay are lifted, threaded through the saddle 5, and anchored to the deck 1.

One advantage of the above-described saddle 5 is that it is compatible with the use of tendons 4 consisting of individually sheathed strands. The section of such a tendon 4 is shown in FIGS. 5 and 6, where reference 16 denotes the twisted metal wires of the strand and reference 17 denotes the plastic sheath that surrounds those wires. The wires 16 are typically of galvanized steel, while the sheath 17 is of high-density polyethylene (HDPE). A flexible fill material fills the spaces between the metal wires 16 and those between the wires 16 and the sheath 17.

The sheathed strand 4, shown in FIGS. 5 and 6 has a circular external section. The support area 11 of the conduits 10 is then designed to have the same radius, r, as the sheathed strand 4. In practice, there can be a slight difference in radius between the support area 11 and the external section of the tendon 4, to the extent that the flow of the plastic material of the sheath 17 pressed against the wall of the conduit remains acceptable. Similarly, it is possible that the external cross-section of the tendon 4 is not exactly circular but, for example, hexagonal with rounded corners, following extrusion of the sheath 17 on the metal strand. In this case, the "external diameter of the tendon" should be understood as being the diameter of the smallest circle in which the cross-section of the tendon can be inscribed. This definition of the "external diameter of the tendon" also holds for an unsheathed metal strand. Although not preferred, the latter case falls within the scope of the invention, the contacts between the stretched tendon and support area 11 of its conduit then following spiral lines instead of being point contacts.

The embodiments mentioned above are illustrations of the present invention. Various modifications can be made without falling outside the scope of the invention, which is based on the attached claims. In particular, the deviation device according to the invention can be used to d structural cables other than stays.

What is claimed:

1. A device for deviating a structural cable having a plurality of stretched tendons, the device comprising:

a body; and conduits extending through said body, wherein each conduit is configured to receive therethrough a single tendon of the plurality of stretched tendons and to guide said single tendon along a curved path, each conduit having a conduit wall, said conduit wall having a support area for supporting said single tendon, wherein said support area is located on an interior side of the curvature of the path, wherein said support area has, at least in a central portion of the conduit and transverse to the curved path, a cross-section forming a circular arc having a radius substantially equal to half the external diameter of said single tendon, and wherein the central portion of the conduit has a widened cross-section outside the support area.

2. The device of claim 1, wherein the circular arc shape of the cross-section of the support area extends over an angular sector of at least 60°.

3. The device of claim 2, wherein the circular arc shape of the cross-section of the support area extends over an angular sector in the range of 90° to 120°.

4. The device of claim 1, wherein the central portion of the conduit presents, outside the support area, a cross-section in the shape of an arch having a diameter greater than an external diameter of the tendon.

5. The device of claim 1, wherein the cross-section of the conduit is sufficient to contain a circle having a diameter at least 2 millimeters greater than an external diameter of the tendon.

6. The device of claim 1, wherein the cross-section of the conduit widens outwardly on at least one side of the central portion of said conduit.

7. The device of claim 6, wherein the outward widening of the cross-section of the conduit follows, on the interior side of the curvature of the path, a substantially circular generatrix having a radius less than a radius of curvature of the path in the central portion of the conduit.

8. The device of claim 1, further comprising a curved tube to receive the structural cable, the body provided with conduits being housed inside the curved tube.

9. A construction work, comprising:

at least one structural cable having a plurality of stretched tendons;

anchors for the tendons at the extremities of the cable; and at least one cable deviation device between the anchors, wherein the deviation device comprises a body and conduits extending through said body, wherein each conduit is configured to receive therethrough a single tendon of the plurality of stretched tendons and to guide said single tendon along a curved path, each conduit having a conduit wall, said conduit wall having a support area for supporting said single tendon, wherein said support area is located on an interior side of the curvature of the path and has at least in a central portion of the conduit and transverse to the curved path, a cross-section forming a circular arc having a radius substantially equal to half the external diameter said single tendon, the central portion of the conduit having a widened cross-section outside the support area.

10. The construction work of claim 9, wherein the circular arc shape of the cross-section of the support area extends over an angular sector of at least 60°.

11. The construction work of claim 10, wherein the circular arc shape of the cross-section of the support area extends over an angular sector in the range of 90° to 120°.

12. The construction work of claim 9, wherein the central portion of the conduit presents, outside the support area, a cross-section in the shape of an arch having a diameter greater than an external diameter of the tendon.

13. The construction work of claim 9, wherein the cross-section of the conduit is sufficient to contain a circle having a diameter at least 2 millimeters greater than an external diameter of the tendon.

14. The construction work of claim 9, wherein the cross-section of the conduit widens outwardly on at least one side of its central portion.

15. The construction work of claim 14, wherein the outward widening of the cross-section of the conduit follows, on the interior side of the curvature of the path, a substantially circular generatrix having a radius less than a radius of curvature of the path in the central portion of the conduit.

16. The construction work of claim 9, wherein each of the tendons has a metal strand and a sheath of plastic material around the strand, wherein the sheath is applied against the support area of the wall of the conduit.

17. The construction work of claim 9, wherein said construction work is in a form of a cable-stayed bridge, wherein the deviation device is installed on a tower of the cable-stayed bridge and the anchors are installed on a deck of the cable-stayed bridge.

18. The construction work of claim 9, wherein the deviation device further comprises a curved tube to receive the structural cable, the body provided with conduits being housed inside the curved tube.

* * * * *